US009617902B2

(12) United States Patent
Takano

(10) Patent No.: US 9,617,902 B2
(45) Date of Patent: Apr. 11, 2017

(54) EXHAUST DEVICE FOR COMBUSTION ENGINE

(71) Applicant: Kawasaki Jukogyo Kabushiki Kaisha, Kobe-shi, Hyogo (JP)

(72) Inventor: Kiyohito Takano, Akashi (JP)

(73) Assignee: KAWASAKI JUKOGYO KABUSHIKI KAISHA (JP)

( * ) Notice: Subject to any disclaimer, the term of this patent is extended or adjusted under 35 U.S.C. 154(b) by 0 days.

(21) Appl. No.: 14/885,921

(22) Filed: Oct. 16, 2015

(65) Prior Publication Data

US 2016/0123211 A1 May 5, 2016

(30) Foreign Application Priority Data

Oct. 29, 2014 (JP) ..... 2014-220272

(51) Int. Cl.
*F01N 1/00* (2006.01)
*F01N 13/10* (2010.01)
*F01N 13/18* (2010.01)

(52) U.S. Cl.
CPC ..... *F01N 13/10* (2013.01); *F01N 13/1805* (2013.01); *F01N 2470/16* (2013.01); *F01N 2590/04* (2013.01)

(58) Field of Classification Search
USPC ..... 60/272, 282, 305, 322, 323, 324
See application file for complete search history.

(56) References Cited

U.S. PATENT DOCUMENTS 5,148,597 A * 9/1992 Weeks ..... F01N 13/08 29/463
6,155,046 A * 12/2000 Kato ..... F01N 13/102 60/322
6,918,246 B2 * 7/2005 Fukumoto ..... F01N 13/08 60/272
7,596,944 B2 * 10/2009 Mueller ..... B01F 3/02 60/272
7,874,149 B2 * 1/2011 Momosaki ..... F01N 3/10 60/299
9,188,049 B2 * 11/2015 Iwata ..... F01N 13/10

FOREIGN PATENT DOCUMENTS

JP 09-144535 6/1997

* cited by examiner

*Primary Examiner* — Binh Q Tran

(57) ABSTRACT

An exhaust device for a combustion engine includes a collecting pipe to which downstream end portions of two exhaust pipes are connected. The downstream end portions of the exhaust pipes are aligned in a lateral direction perpendicular to an axial direction thereof. The downstream end portions of the exhaust pipes have insertion sections that are inserted into an upstream end portion of the collecting pipe. The upstream end portion of the collecting pipe has a cover section that covers the entirety of circumferences of the insertion sections. Outer circumferential surfaces of the insertion sections of the exhaust pipes and an inner circumferential surface of the cover section of the collecting pipe are joined over the entirety of circumferences thereof at a collecting pipe joining region. The collecting pipe joining region has a displacement portion having its position shifted in the axial direction C toward the lateral direction W.

16 Claims, 4 Drawing Sheets

EXHAUST DEVICE FOR COMBUSTION ENGINE

CROSS REFERENCE TO THE RELATED APPLICATION

This application is based on and claims Convention priority to Japanese patent application No. 2014-220272, filed Oct. 29, 2014, the entire disclosure of which is herein incorporated by reference as a part of this application.

BACKGROUND OF THE INVENTION

Field of the Invention

The present invention relates to an exhaust device that includes: a plurality of exhaust pipes for a multi-cylinder engine; and a collecting pipe connected to the downstream side portions of the exhaust pipes.

Description of Related Art

A multi-cylinder engine for a motorcycle has been known in which a plurality of exhaust pipes are collected and connected to a collecting pipe, and the collecting pipe is connected to a muffler, so that, after muffling of exhaust gas is performed by the muffler, the exhaust gas is discharged to the outside (for example, JP Laid-open Patent Publication No. H09-144535). In such an engine, the plurality of exhaust pipes and the collecting pipe are joined to each other by, for example, welding.

At a joining portion where the exhaust pipes each having a small diameter and the collecting pipe having a large diameter are joined to each other, a stepped portion is formed, whereby stress is likely to concentrate in the joining portion. In some cases, in order to avoid such concentration of the stress, a gusset is provided between the exhaust pipes and the collecting pipe so as to gradually vary the diameter of the exhaust pipes, whereby the stepped portion is less likely to be formed. However, in a structure in which such a gusset is provided, the number of components is increased and, further, welding process becomes complicated.

SUMMARY OF THE INVENTION

An object of the present invention is to provide an exhaust device, for an engine, which allows concentration of stress to be reduced and allows exhaust pipes and a collecting pipe to be easily joined to each other without increasing the number of components.

In order to attain the above object, an exhaust device for an engine according to the present invention is directed to an exhaust device, for a multi-cylinder engine, including: a plurality of exhaust pipes disposed such that downstream end portions thereof are aligned in a lateral direction perpendicular to an axial direction thereof; and a collecting pipe connected to the downstream end portions of the exhaust pipes. The downstream end portions of the exhaust pipes have insertion sections that are inserted into an upstream end portion of the collecting pipe. The upstream end portion of the collecting pipe has a cover section that covers the entirety of circumferences of the insertion sections. Outer circumferential surfaces of the insertion sections of the exhaust pipes and an inner circumferential surface of the cover section of the collecting pipe are joined over the entirety of circumferences thereof at a collecting pipe joining region. The collecting pipe joining region has a displacement portion having its position shifted in the axial direction toward the lateral direction relative to the remaining portion thereof. The exhaust pipes and the collecting pipe are joined to each other by, for example, welding.

In this configuration, the collecting pipe joining region has the displacement portion having its position shifted in the axial direction toward the lateral direction, and the collecting pipe and the plurality of exhaust pipes are joined to teach other along the displacement portion. Therefore, welding lines are not linearly aligned along the lateral direction of the exhaust pipes, thereby reducing concentration of stress in the joining region. Further, since an additional component need not be disposed between the collecting pipe and the exhaust pipes, the number of components is not increased, whereby welding process steps can be reduced.

In the present invention, the collecting pipe preferably has paired divisional parts that are separable into two in a direction perpendicular to the lateral direction, and the collecting pipe is preferably formed by the paired divisional parts being joined to each other, and the displacement portion is preferably formed in each of the paired divisional parts. In this configuration, after the exhaust pipes and one of the divisional parts are welded, the exhaust pipes and the other of the divisional parts can be welded, and then, the two divisional parts can be welded to each other. Accordingly, joining of the exhaust pipes and the collecting pipe to each other can be facilitated.

In the present invention, the two adjacent downstream end portions of the plurality of exhaust pipes are preferably joined at an exhaust pipe joining region, and the exhaust pipe joining region is preferably joined to the collecting pipe joining region. In this configuration, a gap between the collecting pipe and the exhaust pipes is not formed. Therefore, leakage of the exhaust gas through a joining area between the collecting pipe and the exhaust pipes can be prevented.

When the downstream end portions of the exhaust pipes are joined at the exhaust pipe joining region, the displacement portion preferably has its position shifted to a downstream side in the axial direction, toward the exhaust pipe joining region, in the lateral direction. In this configuration, since the exhaust pipe joining region can be disposed on the downstream side, a degree of freedom for a layout of the exhaust pipes is enhanced. For example, when the exhaust pipe joining region is disposed on the upstream side, the plurality of exhaust pipes need to approach each other from the upstream side in order to join each other, and handling of the exhaust pipes is difficult.

In the present invention, the collecting pipe joining region is preferably formed at an upstream-side edge of the collecting pipe, and the upstream-side edge of the collecting pipe preferably has lateral opposite ends positioned upstream of a lateral intermediate portion thereof. In this configuration, the collecting pipe joining region of the upstream side edge is formed as a recess, whereby the collecting pipe joining region shifts so as to form a zigzag shape in the axial direction. As a result, rigidity of the collecting pipe joining region is less likely to rapidly vary at the same position in the axial direction, while the rigidity of the collecting pipe joining region can be enhanced.

In the present invention, an axial dimension of the displacement portion is preferably set so as to be greater than or equal to a radius of each exhaust pipe. In this configuration, the displacement portion of the collecting pipe joining region is elongated, whereby rigidity is less likely to rapidly vary at the collecting pipe joining region, while the rigidity of the collecting pipe joining region can be enhanced.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Hereinafter, a preferred embodiment of the present invention will be described with reference to the drawings. In the description herein, "left side" and "right side" represent the left side and the right side, respectively, as viewed from a rider riding a vehicle.

Figure 1:
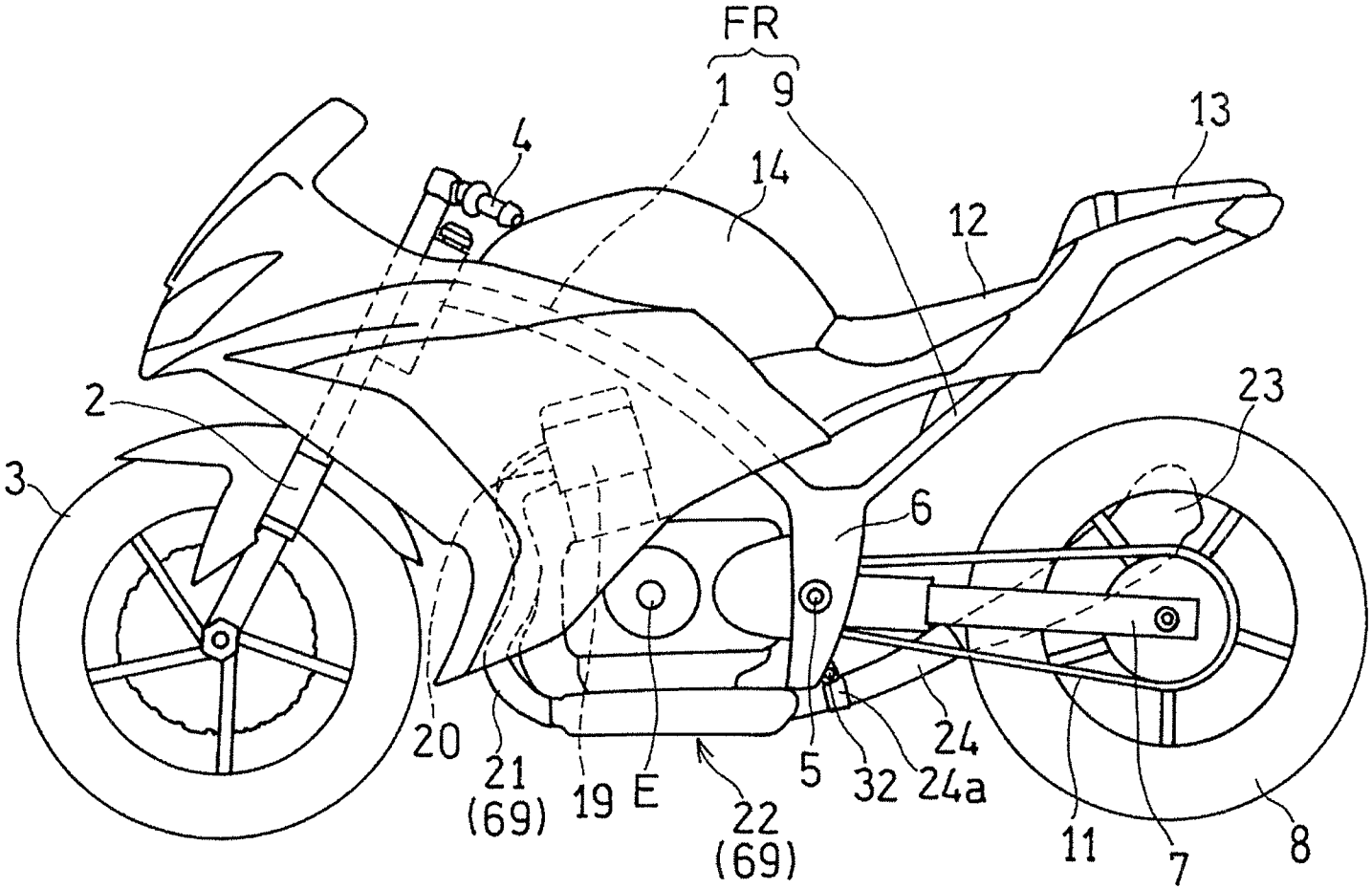
FIG. 1 is a side view of a motorcycle including an exhaust device, for an engine, according to a preferred embodiment of the present invention.

FIG. 1 is a side view of a motorcycle including an exhaust apparatus or exhaust device, for an engine, according to a preferred embodiment of the present invention. The motorcycle shown in FIG. 1 includes a vehicle body frame FR, and the vehicle body frame FR includes a main frame 1 forming a front half of the vehicle body frame FR, and a seat rail 9 which is connected to a rear portion of the main frame 1 and forms a rear half of the vehicle body frame FR. A front fork 2 is supported at the front end of the main frame 1. A front wheel 3 is mounted to the lower end of the front fork 2, and a steering handle 4 is mounted to the upper end of the front fork 2. A swing arm bracket 6 is provided at a lower portion of the rear end of the main frame 1, and the front end of a swing arm 7 is pivotally supported through a pivot shaft 5 by the swing arm bracket 6 so as to swing in the up-down direction. A rear wheel 8 is mounted to the rear end of the swing arm 7.

A combustion engine E is mounted to a lower portion of the main frame 1. In this motorcycle, the rear wheel 8 is driven through a chain 11 by the engine E, and the motorcycle is steered by using the steering handle 4.

A rider's seat 12 and a fellow passenger's seat 13 are supported on the seat rail 9. A fuel tank 14 is mounted between the steering handle 4 and the rider's seat 12 above the main frame 1, that is, at the upper portion of the vehicle body.

The engine E is a two-cylinder, four-cycle combustion engine, and two exhaust pipes 21 of circular cross section having the same outer diameter are connected to an exhaust port 20 in the front surface of a cylinder head 19. These two exhaust pipes 21 are collected at a collection portion 22 below the engine E, and connected through a connection pipe 24 to a muffler 23 disposed on a left side of the rear wheel 8. An exhaust device 69 for the engine E is formed by these two exhaust pipes 21 and the collection portion 22.

Figure 2:
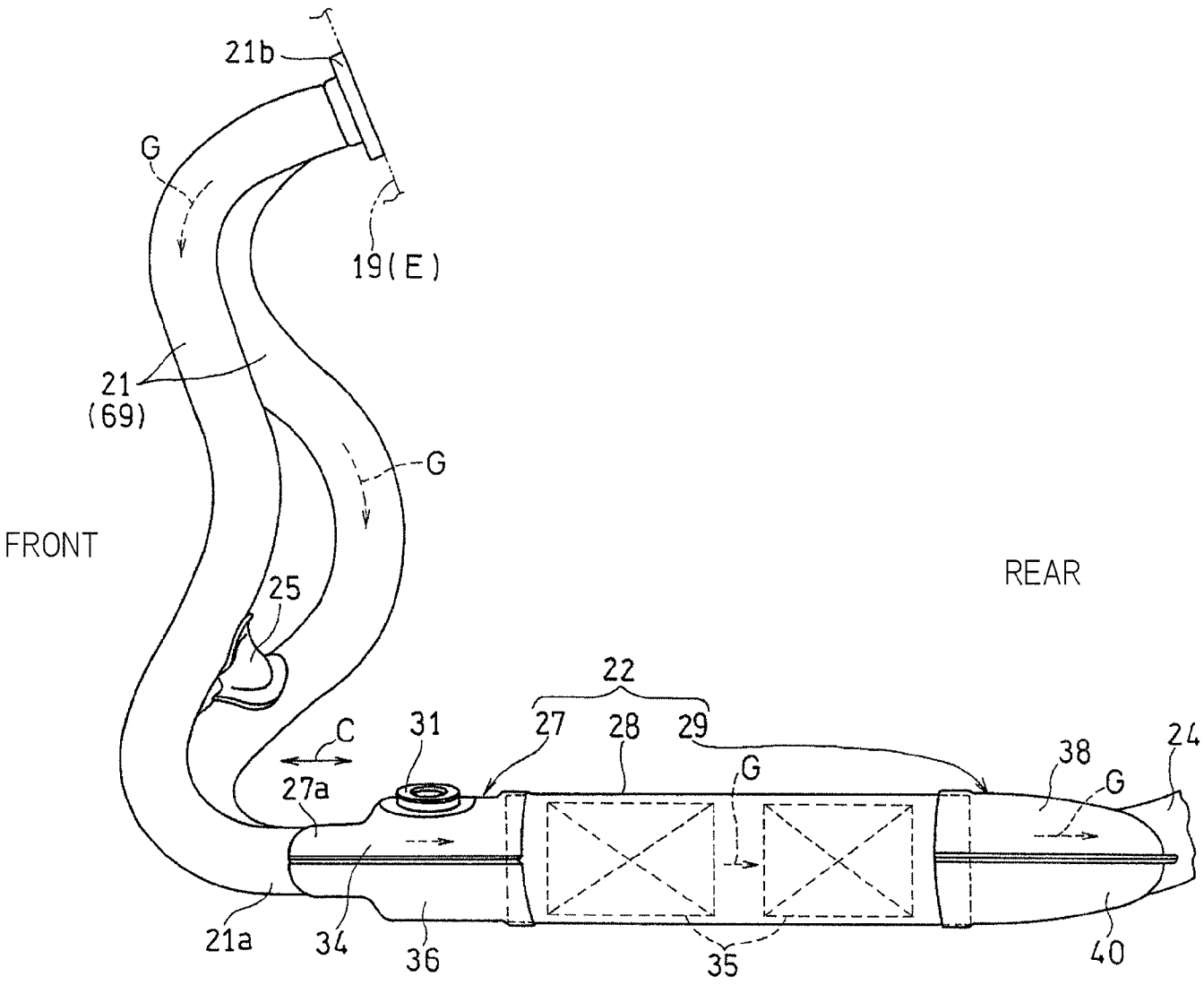
FIG. 2 is a side view of the exhaust device.

FIG. 2 is a side view of the exhaust device 69 for the engine E. As shown in FIG. 2, the two exhaust pipes 21, 21 communicate with each other through a communication pipe 25 at lengthwise intermediate portions of the exhaust pipes 21, 21. The collection portion 22 includes: a collecting pipe 27 to which downstream end portions 21*a* of the two exhaust pipes 21 are joined; a catalyst pipe 28 joined to the downstream end portion of the collecting pipe 27; and an outlet pipe 29 joined to the downstream end portion of the catalyst pipe 28. The connection pipe 24 is joined to the rear end of the outlet pipe 29. The pipes 21, 24, 27, 28, 29 are joined by, for example, arc welding. A mounting seat 31, to which a sensor for detecting a content of oxygen in exhaust gas G is mounted, is provided at the upper portion of the collecting pipe 27.

Each exhaust pipe 21 and the catalyst pipe 28 are each formed as a single pipe made of a stainless steel. The collecting pipe 27 and the outlet pipe 29 are each formed by two pipe halves, which are made of a stainless steel and divided in a radial direction, being welded and connected to each other. Specifically, paired upper and lower collecting pipe divisional parts 34, 36, which are separable into two in a vertical direction perpendicular to an axial direction C of each pipe 27, 29 and a vehicle widthwise direction W (FIG. 3), are joined to each other so as to form the collecting pipe 27. On the other hand, paired upper and lower outlet pipe divisional parts 38, 40 which are separable into two in the vertical direction are joined to each other so as to form the outlet pipe 29.

In the catalyst pipe 28, catalytic converters 35 are accommodated. The two catalytic converts 35 are aligned in a direction of flow of the exhaust gas (the axial direction C) in which exhaust gas flows. The upstream end portion of the catalyst pipe 28 is inserted into the collecting pipe 27, and the catalyst pipe 28 and the collecting pipe 27 are joined by the entirety of the circumferences thereof being welded to each other. Similarly, the downstream end portion of the catalyst pipe 28 is inserted into the outlet pipe 29, and the catalyst pipe 28 and the outlet pipe 29 are joined by the entirety of the circumferences thereof being welded to each other.

The collecting pipe 27 has such a complicated shape as to have a cross-sectional area in which a downstream side portion of the collecting pipe 27 is enlarged as compared to an upstream end portion 27*a* where the exhaust pipes 21 are inserted. The collecting pipe 27 has a so-called "two-part cell structure" formed of the paired divisional parts 34, 36. Therefore, even the collecting pipe 27 having a complicated external shape can be easily manufactured.

A flange 21*b* is mounted to the upstream end portions of the exhaust pipes 21 by welding. The exhaust pipes 21 are supported by the cylinder head 19 of the engine E through the flange 21*b* by means of bolts (not shown). A mounting member 24*a* is fixed to the connection pipe 24 as shown in FIG. 1 by welding. The connection pipe 24 is fixed to the lower end of the main frame 1 through the mounting member 24*a* by means of a bolt 32. As described above, the exhaust device 69 is supported on the vehicle body.

Figure 3:
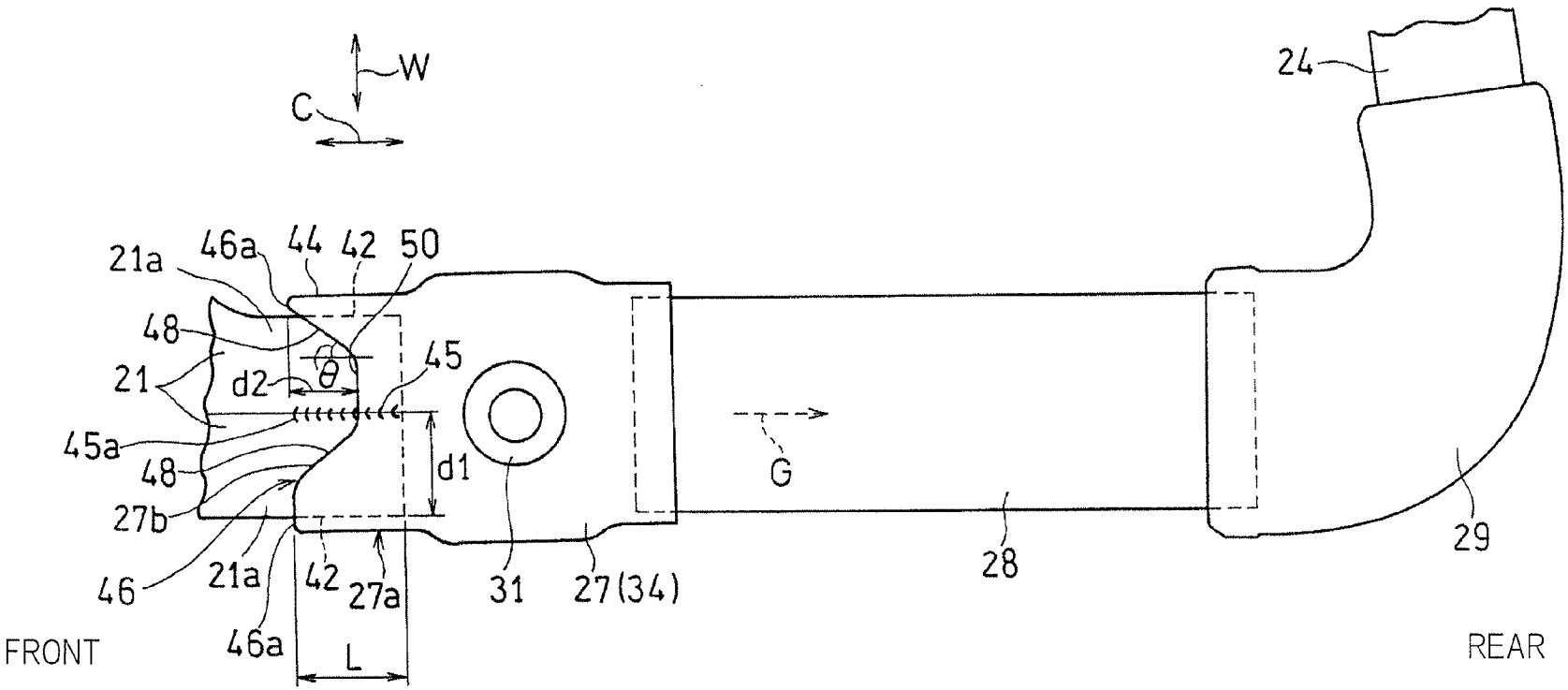
FIG. 3 is a plan view of a collection portion of the exhaust device.

FIG. 3 is a plan view of the collection portion 22. As shown in FIG. 3, the downstream end portions 21*a* of the two exhaust pipes 21 are aligned in the lateral direction W perpendicular to the axial direction C of the exhaust pipe 21. The two downstream end portions 21*a*, 21*a*, of the exhaust pipes 21, 21, adjacent to each other are joined at an exhaust pipe joining region 45 by welding.

The downstream end portions 21*a* of the exhaust pipes 21 have insertion sections 42 that are inserted into the upstream end portion 27*a* of the collecting pipe 27. An axial length L of each insertion section 42 is greater than an outer diameter d1 of each exhaust pipe 21 formed as a circular pipe (L≥d1). Thus, the exhaust pipes 21 and the collecting pipe 27 are firmly joined to each other. The upstream end portion 27*a* of the collecting pipe 27 has a cover section 44 that covers the entirety of the circumferences of the insertion sections 42. The outer circumferential surfaces of the insertion sections 42 of the exhaust pipes 21 and the inner circumferential surface of the cover section 44 of the collecting pipe 27 are welded at a collecting pipe joining region 46 over the entirety of the circumferences thereof. In the present embodiment, the collecting pipe joining region 46 is formed at an upstream side edge 27*b* of the collecting pipe 27. That is, the collecting pipe 27 and the two exhaust pipes 21 are welded along the upstream side edge 27*b* of the collecting pipe 27.

Figure 4:
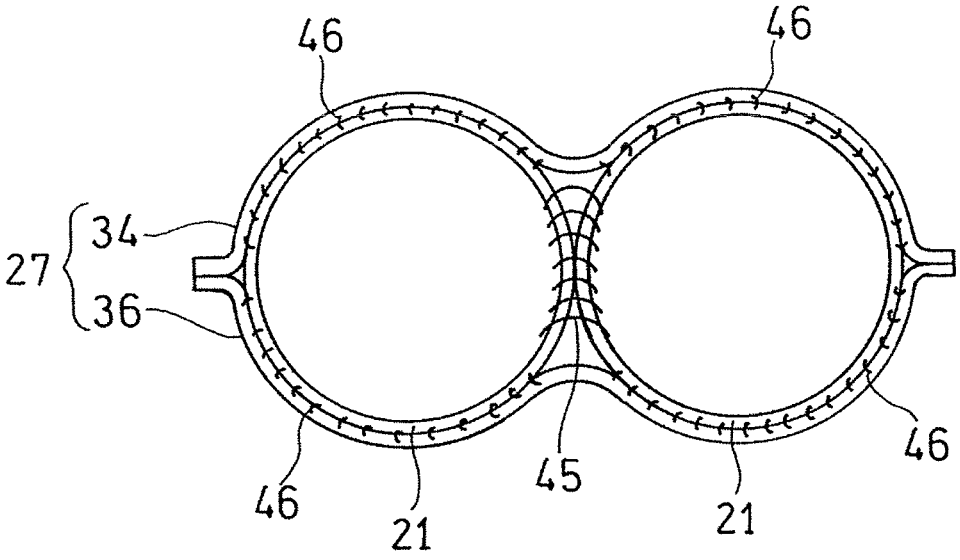
FIG. 4 is a longitudinal cross-sectional view of a joining portion between exhaust pipes and a collecting pipe in the exhaust device.

An upstream end 45*a* of the exhaust pipe joining region 45 is disposed at the same position in the axial direction C as the collecting pipe joining region 46 or disposed upstream of the collecting pipe joining region 46 in the axial direction C. FIG. 4 is a transverse cross-sectional view of the joining portion between the exhaust pipes 21 and the collecting pipe 27. As shown in FIG. 4, the exhaust pipe joining region 45 is joined to the collecting pipe joining region 46.

The collecting pipe joining region 46 shown in FIG. 3 has a displacement portion 48 that has its position shifted in the axial direction C toward the lateral direction W relative to the remaining portion thereof. FIG. 3 shows the displacement portion 48 formed in the upper collecting pipe divisional part 34. The similar displacement portion 48 is also formed in the lower collecting pipe divisional part 36.

The displacement portion 48 has its position shifted from lateral end portions 46*a* of the collecting pipe joining region 46, toward the exhaust pipe joining region 45, to the downstream side (the right side in FIG. 3) in the axial direction C. A portion, of the displacement portion 48, which extends across the exhaust pipe joining region 45 extends along the plane perpendicular to the axial direction C. Thus, the displacement portion 48 is formed in a portion, of the collecting pipe joining region 46, which is inward of the end portions 46*a* in the lateral direction W.

The number of the displacement portions 48 provided is preferably plural. In the present embodiment, the displacement portions 48 are provided at two locations, that is, the upper and lower collective pipe divisional parts 34, 36. The displacement portion 48 is formed as a recess that is recessed toward the downstream side in the axial direction C. In other words, the upstream side edge 27*b*, of the collecting pipe 27, forming the collecting pipe joining region 46 has the opposite ends 46*a*, 46*a*, in the lateral direction W, which are positioned upstream of the inner side portion in the lateral direction, and is V-shaped or U-shaped in a planar view. A bottom portion 50 of the recess is positioned between the downstream end portions 21*a* and 21*a* of the two exhaust pipes 21 and 21. Thus, the exhaust pipe joining region 45, that is, a welded portion of the exhaust pipes 21 can be shortened by a distance corresponding to the recess.

A tilt angle θ of the displacement portion 48 relative to the axial direction C is preferably less than 50°, and is more preferably less than 45°. In the present embodiment, the tilt angle θ is about 40°. An axial dimension d2 of the displacement portion 48 is set so as to be greater than or equal to ½ of the outer diameter d1 of each exhaust pipe 21 (d2≥d1/2). However, as long as the displacement portion 48 has its position shifted in the axial direction C toward the lateral direction W, the shape of the displacement portion 48 is not limited to the shape of the present embodiment. For example, the upper collecting pipe divisional part 34 and the lower collecting pipe divisional part 36 may have the displacement portions 48, 48, respectively, that extend in the axial direction C or in a direction that tilts relative to the axial direction C, and the two displacement portions 48, 48 may be connected at the bottom portion 50 that extends over the two collecting pipe divisional parts 34, 36 so as to form a U-shaped or V-shaped recess as viewed from the outer circumference side.

When the engine E shown in FIG. 1 is started, the exhaust gas G shown in FIG. 2 is introduced through the exhaust pipes 21, to merge in the collection portion 22. In the collection portion 22, the exhaust gas G having been introduced into the collecting pipe 27 is slightly expanded in the collecting pipe 27, and then flows into the catalyst pipe 28. The exhaust gas having passed through the catalytic converters 35 in the catalyst pipe 28 is introduced into the outlet pipe 29 and then, is introduced through the connection pipe 24 into the muffler 23 shown in FIG. 1. The exhaust gas G is, after being sufficiently silenced in the muffler 23, discharged externally from the muffler 23.

In the above structure, the collecting pipe joining region 46 of the collecting pipe 27 shown in FIG. 3 has the displacement portion 48, and the collecting pipe 27 and the exhaust pipes 21 are welded along the collecting pipe joining region 46 including the displacement portion 48. Therefore, welding lines are not linearly aligned along the lateral direction W of the exhaust pipes 21, thereby reducing concentration of stress in the collecting pipe joining region 46. Further, since an additional component such as a gasset need not be disposed between the collecting pipe 27 and the exhaust pipes 21, the number of components is not increased, whereby welding process steps can be reduced.

The displacement portion 48 is formed in each of the upper and the lower collecting pipe divisional parts 34, 36. Thus, after the exhaust pipes 21 and one of the collecting pipe divisional parts 34, 36 are welded, the exhaust pipes 21 and the other of the collecting pipe divisional parts 36, 34 can be welded, and then, the collecting pipe divisional parts 34, 36 can be welded to each other. As a result, joining of the exhaust pipes 21 and the collecting pipe 27 to each other can be facilitated.

The two downstream end portions 21*a*, of the exhaust pipes 21, adjacent to each other are joined at the exhaust pipe joining region 45, and the exhaust pipe joining region 45 is joined to the collecting pipe joining region 46. Thus, a gap between the collecting pipe 27 and the exhaust pipes 21 is not formed. Therefore, leakage of the exhaust gas G through a joining portion between the collecting pipe 27 and the exhaust pipes 21 can be prevented.

The displacement portion 48 has its position shifted to the downstream side in the axial direction C toward the exhaust pipe joining region 45 in the lateral direction W. Thus, the exhaust pipe joining region 45 can be disposed on the downstream side. Therefore, a degree of freedom for a layout of the exhaust pipes 21 is enhanced. For example, when the exhaust pipe joining region 45 is disposed on the upstream side, the exhaust pipes 21 need to laterally approach each other from the upstream side in order to join each other, and handling of the exhaust pipes 21 is difficult.

The collecting pipe joining region 46 of the upstream side edge 27*b* of the collecting pipe 27 is formed as a recess, whereby the collecting pipe joining region 46 shifts so as to form a zigzag shape in the axial direction C. As a result, rigidity of the collecting pipe joining region 46 is less likely to rapidly vary at the same position in the axial direction C, while the rigidity of the collecting pipe joining region 46 can be enhanced.

The axial dimension d2 of the displacement portion 48 is set so as to be greater than or equal to ½ of the outer diameter d1 of each exhaust pipe 21. Thus, the displacement portion 48 of the collecting pipe joining region 46 is elongated, whereby rigidity is less likely to rapidly vary at the collecting pipe joining region 46, while the rigidity of the collecting pipe joining region 46 can be enhanced.

The present invention is not limited to the embodiments described above. Various additions, modifications, or deletions may be made without departing from the gist of the present invention. For example, the exhaust pipes 21 and the collecting pipe 27 may be joined to each other by not only arc welding but also friction stir welding, brazing, bonding, adhesion, or the like. The collecting pipe joining region 46 may be disposed downstream of the upstream side edge 27*b* of the collecting pipe 27. The exhaust device of the present invention is also applicable to engines other than two-cylinder engines, for example, to four-cylinder engines or three-cylinder engines. However, the exhaust device of the present invention is particularly preferably used for two-cylinder engines in which vibration is large.

In the above embodiments, the vehicle widthwise direction is set as a direction (lateral direction) in which the exhaust pipes 21 are juxtaposed. However, the vertical direction may be set as a direction (lateral direction) in which the exhaust pipes 21 are juxtaposed. The collecting pipe 27 may not have the "two-part structure". The displacement portion 48 may have a projection that projects towards the upstream side in the axial direction C.

Therefore, these are construed as included within the scope of the present invention.

REFERENCE NUMERALS

21 . . . exhaust pipe
21*a* . . . downstream end portion of exhaust pipe
27 . . . collecting pipe
27*a* . . . upstream end portion of collecting pipe
27*b* . . . upstream side edge of collecting pipe
34 . . . upper collecting pipe divisional part (paired divisional parts)
36 . . . lower collecting pipe divisional part (paired divisional parts)
42 . . . insertion section
44 . . . cover section
45 . . . exhaust pipe joining region
46 . . . collecting pipe joining region
48 . . . displacement portion
69 . . . exhaust device
C . . . axial direction
E . . . engine
G . . . exhaust gas
W . . . lateral direction

What is claimed is:

1. An exhaust device, for a multi-cylinder engine, comprising: a plurality of exhaust pipes disposed such that downstream end portions thereof are aligned in a lateral direction perpendicular to an axial direction thereof; and a collecting pipe connected to the downstream end portions of the exhaust pipes, wherein:

the downstream end portions of the exhaust pipes have insertion sections that are inserted into an upstream end portion of the collecting pipe, the upstream end portion of the collecting pipe has a cover section that covers the entirety of circumferences of the insertion sections;

outer circumferential surfaces of the insertion sections of the exhaust pipes and an inner circumferential surface of the cover section of the collecting pipe are joined over the entirety of circumferences thereof at a collecting pipe joining region, the collecting pipe joining region has a displacement portion having its position shifted in the axial direction toward the lateral direction relative to the remaining portion thereof, and the displacement portion is formed as a recess that is recessed toward the downstream side in the axial direction.

2. The exhaust device as claimed in claim 1, wherein:

the collecting pipe has paired divisional parts that are separable into two in a direction perpendicular to the lateral direction, and the collecting pipe is formed by the paired divisional parts being joined to each other; and the displacement portion is formed in each of the paired divisional parts.

3. The exhaust device as claimed in claim 1, wherein:

the two adjacent downstream end portions of the plurality of exhaust pipes are joined at an exhaust pipe joining region;

the exhaust pipe joining region is joined to the collecting pipe joining region; and a bottom portion of the recess is positioned between the two downstream end portions of the exhaust pipes.

4. The exhaust device as claimed in claim 1, wherein an axial dimension of the displacement portion is set so as to be greater than or equal to a radius of each exhaust pipe.

5. The exhaust device as claimed in claim 1, wherein:

the two adjacent downstream end portions of the plurality of exhaust pipes are joined at an exhaust pipe joining region; and a portion of the displacement portion which extends across the exhaust pipe joining region extends along a plane perpendicular to the axial direction.

6. The exhaust device as claimed in claim 2, wherein:

each of the paired divisional parts has the displacement portion; and the respective displacement portions are connected at a bottom portion that extends over the paired divisional parts so as to form a U-shaped recess.

7. The exhaust device as claimed in claim 2, wherein the collecting pipe has a cross-sectional area in which a downstream side portion of the collecting pipe is enlarged as compared to an upstream end portion thereof where the exhaust pipes are inserted.

8. The exhaust device as claimed in claim 1, wherein a tilt angle θ of the displacement portion relative to the axial direction is set to be less than 45°.

9. The exhaust device as claimed in claim 1, wherein:

the exhaust pipe is formed as a circular pipe;

the downstream end portion of the exhaust pipe has an insertion section that are inserted into the upstream end portion of the collecting pipe; and an axial length L of the insertion section is greater than an outer diameter d1 of the exhaust pipe.

10. The exhaust device as claimed in claim 1, wherein the displacement portions are provided at plural locations in the lateral direction.

11. A saddle-riding vehicle comprising the exhaust device as claimed in claim 1, wherein the engine is disposed rearwardly of a front wheel;

the exhaust pipes are connected to an exhaust port defined at a front surface of the engine;

the two downstream end portions of the exhaust pipes are adjacent to each other;

the collecting pipe is disposed below the engine: and the collecting pipe has an upper portion provided with a mounting seat, to which a sensor for detecting a content of oxygen in exhaust gas is mounted, the mounting seat being disposed downstream of the two downstream end portions of the exhaust pipes.

12. The exhaust device as claimed in claim 1, wherein the exhaust pipes are welded to the collecting pipe along the collecting pipe joining region including the displacement portion.

13. The exhaust device as claimed in claim 12, wherein welding lines are formed along the collecting pipe joining region, and wherein the welding lines are not aligned in the lateral direction.

14. The exhaust device as claimed in claim 1, wherein the displacement portion forms a zigzag shape in the axial direction around the collecting pipe joining region.

15. The exhaust device as claimed in claim 1, wherein a distance d2 of the recess is greater than or equal to half of the outer diameter d1 of the exhaust pipe.

16. An exhaust device, for a multi-cylinder engine, comprising:

a plurality of exhaust pipes disposed such that downstream end portions thereof are aligned in a lateral direction perpendicular to an axial direction thereof; and a collecting pipe connected to the downstream end portions of the exhaust pipes, the collecting pipe including a mounting seat, to which a sensor for detecting a content of oxygen in exhaust gas is mounted, wherein:

the downstream end portions of the exhaust pipes are joined together and have insertion sections that are inserted into an upstream end portion of the collecting pipe, the upstream end portion of the collecting pipe has a cover section that covers the entirety of circumferences of the insertion sections, outer circumferential surfaces of the insertion sections of the exhaust pipes and an inner circumferential surface of the cover section of the collecting pipe are joined over the entirety of circumferences thereof at a collecting pipe joining region, and the collecting pipe joining region has a displacement portion shifted in the axial direction and formed as a recess that is recessed toward the downstream side in the axial direction.

* * * * *